US005818478A

United States Patent [19]

Gibson

[11] Patent Number: 5,818,478

[45] **Date of Patent: *Oct. 6, 1998**

[54] INK JET NOZZLE PLACEMENT CORRECTION

[75] Inventor: Bruce David Gibson, Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 692,029

[22] Filed: Aug. 2, 1996

[51] Int. Cl.[6] ..... B41J 2/135; B41J 2/14

[52] U.S. Cl. ..... 347/45; 347/47; 29/890.1; 29/611

[58] Field of Search ..... 347/45, 47; 29/890.1, 29/611

[56] References Cited

U.S. PATENT DOCUMENTS

| | | | |
|---|---|---|---|
| 4,392,907 | 7/1983 | Shirato et al. | 156/252 |
| 4,394,669 | 7/1983 | Ozawa et al. | 347/86 |
| 4,725,851 | 2/1988 | Sutera et al. | 346/75 |
| 5,376,204 | 12/1994 | Amano | 156/234 |
| 5,387,314 | 2/1995 | Baughman et al. | 156/643 |
| 5,412,412 | 5/1995 | Drake et al. | 347/40 |
| 5,450,113 | 9/1995 | Childers et al. | 347/87 |
| 5,453,769 | 9/1995 | Schantz et al. | 347/63 |
| 5,467,115 | 11/1995 | Childers | 347/47 |
| 5,512,117 | 4/1996 | Morris | 216/20 |

*Primary Examiner*—Valerie Lund
*Assistant Examiner*—Christina Annick
*Attorney, Agent, or Firm*—John J. McArdle, Jr.

[57] ABSTRACT

Nozzles in an ink jet printhead nozzle plate are laser formed into the nozzle plate at a spacing differing from that of the corresponding ink heating elements by a function of the thermal expansion characteristics whereby heating of the nozzle plate to activate a heat set adhesive for securing the nozzle plate to the heating element substrate expands the nozzle plate thereby aligning the nozzle axes with the corresponding heating elements.

15 Claims, 3 Drawing Sheets

INK JET NOZZLE PLACEMENT CORRECTION

BACKGROUND OF THE INVENTION

The present invention generally relates to ink jet and other types of printers and, more particularly, to a method for printhead construction for an ink cartridge used in such printers.

Thermal ink jet print cartridges operate by rapidly heating a small volume of ink to generate a bubble caused by rapid vaporization of an ink vehicle for driving ink through one or more of a plurality of orifices so as to deposit one or more drops of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead moves across the paper. The thermal ink jet printer is generally fast and quiet, as only the ink droplet is in contact is with the paper. Such printers produce high quality printing and can be made both compact and economical.

In one prior art design, the ink jet printhead includes: (1) ink channels to supply ink from an ink reservoir to each vaporization chamber proximate to an orifice; (2) a polymeric orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is heated, in turn superheating a thin layer of the ink adjacent the resistor surface within a vaporization chamber, causing explosive vaporization of the ink vehicle, and, consequently, causing a droplet of ink to be ejected through an associated orifice onto the paper.

While there are numerous fabricational methods for manufacturing the ink jet printhead, most methods bond the resistors to the silicon substrate in a precise pattern and separation distance. The nozzles and sometimes the corresponding vaporization chambers are formed in a separate structural element as by laser cutting or milling a sheet of thin polymer or metal material for example. The nozzle bearing element is characterized as a nozzle plate which is bonded or otherwise attached to the resistor bearing surface of the silicon substrate.

In assembly, the pattern and spacing of the nozzle axes must correspond with the respective pattern and spacing of the resistors.

A bubble of vapor is generated from the film of ink vehicle that is vaporized by contacting the hot resistor surface. Consequently, the center of the bubble generally coincides with the center of area of the distributed heat source. Usually, this translates to the areal center of the resistor. In the rush of the vapor to escape confinement by release through the nozzle aperture, it follows a direct flight line from the resistor center of area to the nozzle aperture pushing a wave of liquid ink ahead along the flight line projection. From this wave of liquid ink driven through the nozzle aperture, a single ink droplet is formed. Hence, misalignment of this flight line from the normal nozzle axis results in a skewed ink discharge trajectory. Desirably, the theoretical nozzle axis will be perpendicular to the silicon substrate plane and intersect the resistor center of area and the centroid of the vaporization chamber.

When the vaporization chamber and nozzle are integrated with the nozzle plate, two of the three alignment parameters are controlled in the nozzle plate fabrication process. Although this simplifies the fabrication process by requiring only that the nozzle axis must be located normal to the nozzle plate and silicon substrate assembly at the resistor center of area, there may be eight or more nozzles and corresponding resistors in a printhead and all must meet the required co-alignment parameter simultaneously.

However, difficulties arise with respect to positioning and bonding the nozzle plate to the substrate surface. Solder and hot melt bonds often require both surfaces to be heated. Since the surfaces are formed from different materials, the two will not respond to the requisite heating in the same manner. Each material having a distinctive coefficient of expansion will expand at a respective rate that is a function of the material coefficient and the relevant assembly temperature, i.e. the temperature differential between the assembly temperature and ambient temperature. Furthermore, the ink jet printhead elements are fabricated at one temperature but bonded together at another temperature. Accordingly, components that were fabricated to align at ambient temperature, do not align at the assembly or bonding temperature.

It is an object of the present invention, therefore, to provide a method of fabricating ink jet printheads that discharge ink from all nozzles along a nozzle axis trajectory substantially perpendicular to the nozzle plate.

Another object of the present invention is to provide an ink jet fabrication method that aligns each nozzle axis with a respective heating element.

A still further object of the present invention is a method for assembling a printhead with temperature activated bonding agents that will have substantially all ink discharge nozzle axes aligned with the ink heating elements when all elements of an assembled unit have cooled to ambient temperature.

SUMMARY OF THE INVENTION

These and other objects of the invention to be subsequently described or implied by the following detailed description of the invention are accomplished by an ink jet printhead that is fabricated by positioning a multiplicity of ink heating elements in alignment upon and bonded to a structural substrate surface and in a first predetermined order of separation. An ink supply channel, vapor chamber and discharge nozzle aperture associated with each heating element is laser formed in a sheet material nozzle plate with the nozzle aperture alignment corresponding to the heating element alignment but with each nozzle spaced in a second predetermined order of separation. The second order of separation differs from the first order of separation by a function proportional to a thermal expansion characteristic or rate for the nozzle plate material such as the coefficient of linear expansion whereby heating of the nozzle plate to activate a heat set adhesive or bonding agent for securing the nozzle plate to the substrate surface expands the nozzle plate material to transpose the nozzles into substantial alignment with the heating elements. Subsequent to nozzle plate bonding and upon cooling, the nozzles positionally stabilize in alignment with the heating elements so that the nozzle axes are substantially perpendicular to respective heating element surfaces, are substantially spaced by the first order of separation and generally correspond to the desired direction of ink discharge from the nozzles.

Other features and advantages of the invention may be determined from the drawings and detailed description of the invention that follows.

BRIEF DESCRIPTION OF THE DRAWINGS

The present invention may be further understood by reference to the following description and attached drawings which illustrate the preferred invention embodiment and wherein.

DETAILED DESCRIPTION OF THE PREFERRED EMBODIMENTS

Figure 1:
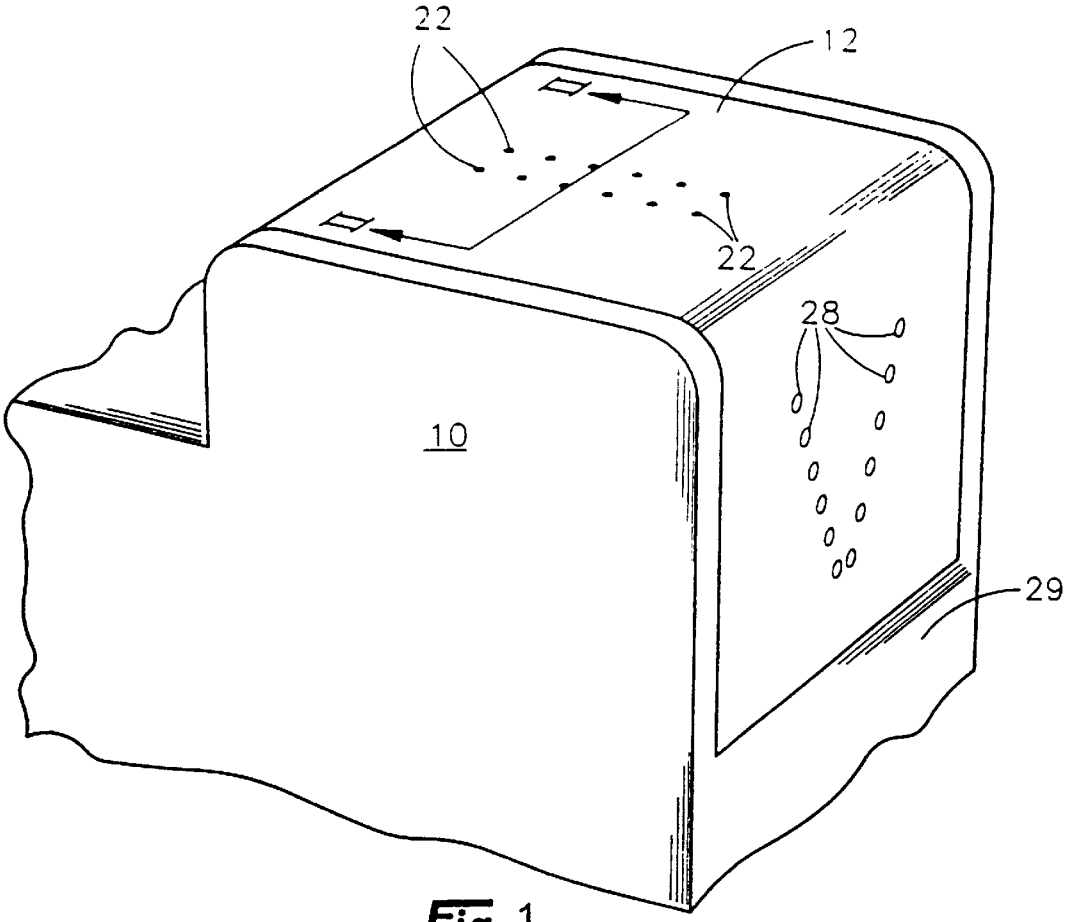
FIG. 1 is a partial perspective view of an ink jet cartridge and printhead.

For a detailed description of the preferred invention embodiments, reference is made to the accompanying drawings wherein like reference characters designate like or similar elements throughout the several figures of the drawings.

Figure 2:
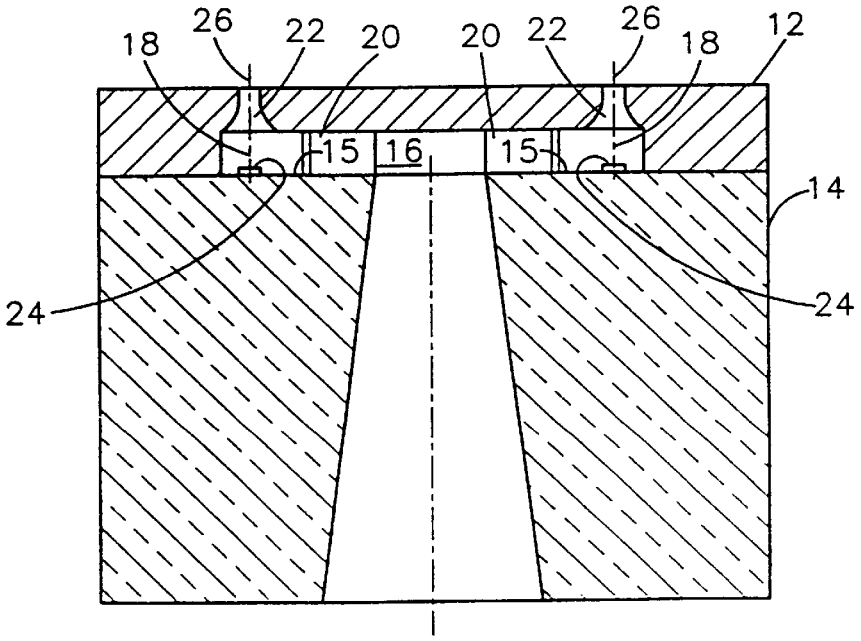
FIG. 2 is an enlarged sectional detail of an ink jet printhead.
Figure 3:
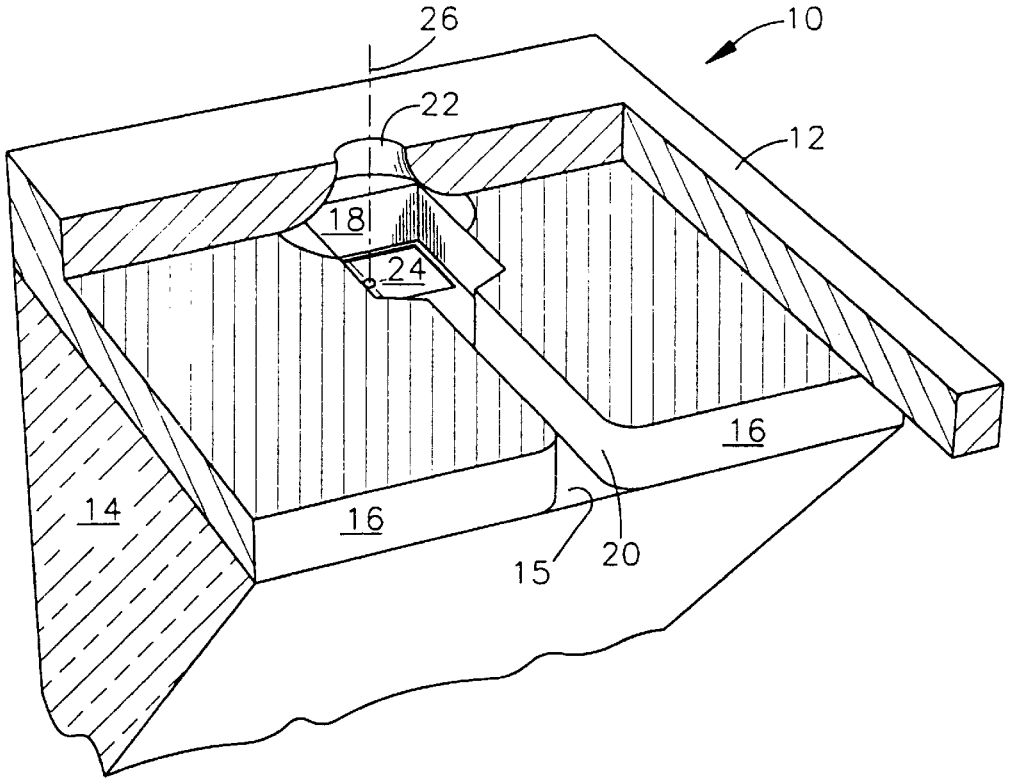
FIG. 3 is a selectively sectioned perspective of the present invention printhead.

The printhead 10 of FIGS. 1, 2 and 3 comprises a nozzle plate 12 that is adhesively bonded to a silicon substrate base 14. Formed within nozzle plate 12 is an ink supply labyrinth comprising a channel 16, a multiplicity of ink vaporization chambers 18, connective conduit laterals 20 and nozzle orifices 22. Heating resistors 24 are bonded to the surface 15 of the substrate base substantially within the cross-sectional center of a respective vaporization chamber 18. Ideally, the center of area of the heating resistor 24 should also be aligned with or substantially intersected by the respective nozzle axis 26: assuming, of course, that the substrate surface 15 supporting the heater resistors 24 is substantially perpendicular to the nozzle axis 26.

Printed electrical conduits (not shown) connect the heater resistors 24 to electrical contact pads 28 on the side surface of the printhead 29. A computer controlled switching program and apparatus selectively connects an appropriate electrical energy source (not shown) to the pads 28 as required to "fire" the ink resistors 24 in the sequence necessary to meet the computer directed graphic requirements.

In a preferred embodiment of the invention, the cavities in nozzle plate 12 representing the nozzles 22, vaporization chambers 18 and supply channels 16 are formed by a laser milling process prior to attaching of the nozzle plate 12 to the substrate base 14. Preferably, nozzle plate 12 is formed from a polymeric material, including an approximately 2 mil. thick layer of polyimide material and having an about 0.5 mil. layer of phenolic butyryl adhesive on one face. Such a polymeric material is available from Rogers Corporation of Chandler Arizona and sold under the trademark R%FLEX-1100.

In the first step of the process, the adhesive side of the polyamide film is coated with 2–5 microns of polyvinyl alcohol (PVA). After coating the adhesive side of the film, the PVA coating is heat treated for more than 10 minutes at a temperature of 70° C. to affix the PVA to the surface of the adhesive. Next, the polymeric material is slit to a standard 35 mm width and sprocket holes are punched along the film strip longitudinal edges.

The slit and sprocketed film strip is then fed to a first platen containing vacuum holes for holding the film during the laser milling step. In the first step of the laser milling process, a two position mask is positioned in a first position so that the nozzle orifices 22 are milled through the polymeric material. Typically, a nozzle orifice may have an entrance diameter of about 43 microns and an exit diameter of about 29 microns with a connecting taper of about 8.5° from vertical.

The laser milling mask is relocated to the second position for cutting the supply channel 16 and the connective lateral 20 and vaporization chamber 18 respective to each nozzle orifice.

After the nozzle orifices and flow channels are cut in the polyamide film, the film is moved to a second vacuum platen for delineating the perimeter of each nozzle plate on the film strip with a laser ablated kerf leaving web connections across the kerf to keep each plate 12 in assembly with the film strip which is subsequently re-wound on a spool.

Thereafter, the re-wound spool of film is unrolled through a 60° C. water bath and then through a wash station under 40 to 80 psi of 55°–65° C. de-ionized water sprays for removal of the PVA coating. The film is dried by passing under a series of 3 to 5 air knives.

After removal of the PVA coating, the kerf around each nozzle plate 12 in the film perimeter is completed. The laser cut nozzle plates are removed from the film by a robot finger which then positions the nozzle plate on a disc containing multiple silicone substrates 14. The nozzle plates 12 are then tacked to respective silicon substrates 14 using a hot shoe at about 100° C. for about 8 to 10 seconds with the aid of a silane adhesion promoter. The phenolic butyl adhesive is then cured in a 130° C. oven for about 45 minutes.

Figure 4:
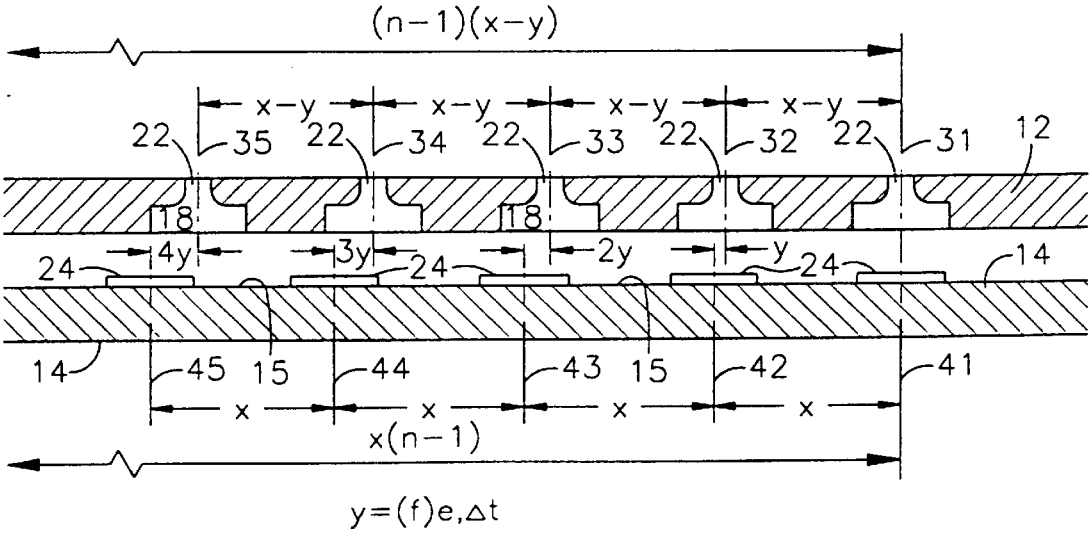
FIG. 4 is an enlarged sectional detail of a printhead nozzle assembly with dimensioned spacial relationships.

With reference to FIG. 4 and the above described manufacturing procedure, a silicon substrate base 14 is shown with a line of multiple heating resistors 24, a quantity for example, secured to the surface 15 at uniform spacings x so that the total distance between the center of area of first resistor 24 and the center of area of the last resistor is x(n−1) units. Spacing between adjacent nozzle axes 31, 32 etc. in the corresponding nozzle plate 12 is milled at ambient temperature at a distance of (x-y) whereby the total distance between the first and last nozzle axis is (n−1)(x-y). The operative variable in this relationship is a value which is a function of the polymeric material coefficient of expansion e and the temperature differential Dt between the ambient temperature of milling and the adhesive curing temperature. Depending on the materials used and the geometry of the nozzle plate, the functional proportionality between the coefficient of expansion e and the relevant temperature differential may be linear or exponential. The following equation represents the functional proportionality between the coefficient of expansion e and the relevant temperature differential.

$$y=(f)e,Dt$$

As represented by FIG. 4, a reference nozzle axis 31 on the right projects normally to the substrate surface 15 and is coincident with the axis 41 through the cooperative resistor 24 center of area. Accordingly, the nozzle 22 and resistor 24 corresponding to axes 31 and 41 are mutually aligned for a normal ink droplet discharge.

Moving to the left from the reference axis 31–41, are a multiplicity of n−1 resistors 24, each spaced X units apart. The total distance between the center of area of the first resistor and the center of area of the last resistor being x(n−1) where n is the total number of resistors in the line.

Starting from the same reference axis 31–41 and moving to the left, are a succession of nozzles 22. The distance between adjacent nozzles 22 is, at the temperatures ambient to the milling process, set at a distance y less than the distance X between the resistors. Consequently, between adjacent nozzles axes 31 and 32, the distance is x-y. The distance is also x-y between nozzle axes 32 and 33, 33 and 34, 34 and 35 etc. Cumulatively, therefor, the offset between the normal nozzle axis 32 and the area center axis 42 of the next resistor is y. The offset between axes 33 and 43 is 2y, between axes 34 and 44 is 3y, between axes 35 and 45 is 4y etc. Accordingly, if the distance between the first resistor center of area and the $n^{th}$ resistor center of area at the ambient temperature is x(n−1), then the fabrication space between the first and $n^{th}$ nozzle is (x-y)(n−1) at the ambient fabrication temperature.

Some applications of the invention will find it more convenient to set the reference axis common to both nozzle and corresponding resistor at the center of a nozzle line. The overall distance between the opposite end nozzles remains the same as analyzed above but when analyzed in opposite directions from a midpoint reference, the offsets are divided equally between the opposite directions from the center reference.

When the nozzle plate is heated for adhesive bonding to the substrate, the nozzle plate expands as a function of the plate material coefficient of expansion and the operative temperature differential. When cured at the higher temperature, the adhesive holds the plate 12 to the silicon substrate base 14 at the relative dimensional position that existed between the two elements when hot. By milling the nozzle orifices at the ambient temperature or cold shrink position rather than the final desired spacing, the initial nozzle spacing grows with the material heating to a hot spacing nozzle position that locates the multiple nozzle axes substantially at the center of each heater resister area.

Figure 5:
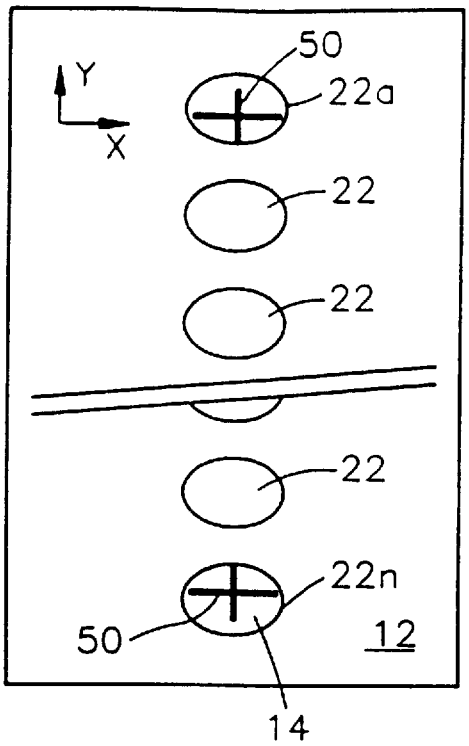
FIG. 5 is a detail view of the invention representing an alternative alignment procedure for the nozzle plate assembly to the printhead.

FIG. 5 illustrates the above procedure applied with a central reference axis common to both, the plate 12 and the substrate 14. Sighting crosses 50 are located on the substrate 14 equidistant from a central reference axis not shown. These sighting crosses are alignment targets for locating the ambient temperature plate 12. The ambient temperature plate 12 is positioned over the substrate 14 to center the sighting crosses 50 under the endmost nozzles 22*a* and 22*n*. While in such alignment, the nozzle plate is heated for adhesive bonding to the substrate. The symmetric displacement of the sighting crosses 50 within the sight field of nozzles 22*a* and 22*n* of FIG. 5 represents the plate expansion to a position of coaxial alignment between the nozzle axes and the resistor axes.

The invention has been described in relation to nozzle placement correction wherein the ink channels, ink chambers and nozzle orifices are formed in the same polymeric material. It is contemplated, however, that the fabrication methods and techniques described above may be applied to effect nozzle placement correction in nozzle assemblies wherein the nozzle plate does not include ink channels and/or ink chambers. Furthermore, the methods and techniques of the invention are not limited to nozzle plates made of a polymeric material, but rather, may be adapted for use in correcting nozzle placement in nozzle assemblies wherein the nozzle plate is formed from other materials, such as for example, metal.

While preferred embodiments of the present invention are described above, it will be appreciated by those of ordinary skill in the art that the invention is capable of numerous modifications, rearrangements and substitutions of parts without departing from the spirit and scope of the appended claims.

I claim:

1. A method of manufacturing an ink jet printhead comprising:

depositing a plurality of heating elements on a silicon substrate surface at spaced intervals along a first line of alignment and with a first order of separation between adjacent heating elements;

forming a plurality of nozzle apertures in a planar polymeric nozzle plate material while maintaining the nozzle plate material at a first temperature, wherein the nozzle apertures are formed along a second line of alignment with a second order of separation between adjacent nozzle apertures that differs from the first order of separation by a function proportional to a thermal expansion coefficient for the nozzle plate material; and, heating the nozzle plate to a second temperature, said second temperature being greater than said first temperature in order to expand the nozzle plate to an expanded condition such that the second order of separation of the nozzle apertures substantially aligns with the first order of separation of the heating elements and bonding the nozzle plate to the substrate in the expanded condition.

2. A method of manufacturing as described by claim 1 wherein an n number of heating elements are distributed on said substrate surface at intervals of x over a distance of substantially x(n−1).

3. A method of manufacturing as described by claim 2 wherein a corresponding n number of nozzle apertures formed in said nozzle plate material are distributed at intervals of substantially (x-y)(n−1) wherein y is a function (f) of the nozzle plate material thermal expansion coefficient (e) and a temperature difference (Dt) between the first temperature of said nozzle plate material when the nozzle apertures are formed therein and the second temperature of said nozzle plate material when said nozzle plate is attached to said substrate as defined by the equation y=(f)e,Dt.

4. A method as described by claim 3 wherein the function of y in the equation represents a non-linear function of e and Dt.

5. The method of claim 1 wherein the polymeric nozzle plate material comprises a polyimide material.

6. A method of manufacturing an inkjet printhead comprising:

depositing a plurality of heating elements on a silicon substrate surface at spaced intervals along a first line of alignment and with a first order of separation between adjacent heating elements;

forming a plurality of nozzle apertures in a planar polymeric nozzle plate material while maintaining the nozzle plate material at a first temperature, wherein the nozzle apertures are formed along a second line of alignment with a second order of separation between adjacent nozzle apertures that differs from the first order of separation by a function proportional to a thermal expansion coefficient for the nozzle plate material; and, positioning said nozzle plate material adjacent said substrate surface with said second line of alignment substantially coinciding with said first line of alignment;

heating said nozzle plate material to a second temperature which is greater than said first temperature whereby said nozzle plate expands to an expanded condition so that said nozzle apertures axially align with said thermal elements at substantially the same spacing; and thermally bonding said nozzle plate material in the expanded condition to said substrate surface.

7. A method as described by claim 6 wherein an n number of heating elements are distributed on said substrate surface at intervals of x over a distance of substantially x(n−1).

8. A method as described by claim 7 wherein a corresponding n number of nozzle apertures formed in said nozzle plate material are distributed at intervals of substantially (x-y)(n−1) wherein y is a function (f) of the nozzle plate material thermal expansion coefficient (e) and a temperature difference (Dt) between the first temperature of said nozzle plate material when said nozzle apertures are formed therein and the second temperature of said nozzle plate material when said nozzle plate is bonded to said substrate as defined by the equation y=(f)e,Dt.

9. A method as described by claim 8 wherein the function of y in the equation represents a non-linear function of e and Dt.

10. The method of claim 6 wherein the polymeric nozzle plate material comprises a polyimide material.

11. A method of manufacturing an inkjet printhead having a plurality of nozzle apertures formed in a nozzle plate material that is adhesively secured to a heater substrate, said method comprising the steps of:

securing a plurality of electrical heating elements to a surface of a heater substrate made of silicon at substantially uniformly spaced intervals between adjacent heating elements along a first line of alignment;

forming nozzle apertures in a planar polymeric nozzle plate material while maintaining the nozzle plate material at a first temperature, wherein the nozzle apertures are formed around discharge axes substantially perpendicular to the nozzle plate material and along a second line of alignment, said nozzle plate material having a known rate of thermal expansion, said nozzle apertures being spaced along said second line of alignment at intervals differing from said heating element intervals by a function corresponding to said rate of thermal expansion applied to a temperature differential between said first temperature and a second temperature corresponding to an adhesion temperature, said second temperature being greater than said first temperature;

expanding said nozzle plate material by heating said nozzle plate material to said second temperature; and securing said expanded nozzle plate material to said substrate with a thermosetting adhesive at a temperature proximate of said second temperature.

12. A method of manufacturing a printhead as described by claim 11 wherein n heating elements are secured to the surface of said heater substrate at substantially x spacing intervals over a distance of substantially x(n−1).

13. A method of manufacturing a printhead as described by claim 11 wherein a corresponding n number of nozzle apertures formed in said nozzle plate material are distributed at intervals of substantially (x-y)(n−1) wherein y is a function (f) of the rate of thermal expansion of said nozzle plate material applied to a temperature difference (Dt) between said first and said second temperature as defined by the equation y=(f)e,Dt, wherein e is a thermal expansion coefficient for the nozzle plate material.

14. A method of manufacturing a printhead as described by claim 13 wherein the function of y in the equation represents a non-linear function of e and Dt.

15. The method of claim 11 wherein the polymeric nozzle plate material comprises a polyimide material.

* * * * *